US006659664B1

(12) United States Patent
Holland et al.

(10) Patent No.: US 6,659,664 B1
(45) Date of Patent: Dec. 9, 2003

(54) INK RIBBON CARTRIDGE WITH EXPANDABLE SIDEPLATES

(75) Inventors: Carl William Holland, Webster, NY (US); Donald J. Watters, Fairport, NY (US)

(73) Assignee: Nu-kote International, Inc., Dallas, TX (US)

( * ) Notice: Subject to any disclaimer, the term of this patent is extended or adjusted under 35 U.S.C. 154(b) by 0 days.

(21) Appl. No.: 09/995,354

(22) Filed: Nov. 27, 2001

(51) Int. Cl.[7] ..... B41J 35/28
(52) U.S. Cl. ..... 400/207; 400/242
(58) Field of Search ..... 400/207, 208, 400/242, 208.1

(56) References Cited

U.S. PATENT DOCUMENTS

| | | | | | |
|---|---|---|---|---|---|
| 4,586,616 | A | * | 5/1986 | Cooper et al. | 211/88.04 |
| 4,867,585 | A | * | 9/1989 | Dirla | 400/208 |
| 5,128,763 | A | * | 7/1992 | Sakuragi | 358/296 |
| 5,352,049 | A | * | 10/1994 | Shiraishi et al. | 400/208 |
| D355,436 | S | | 2/1995 | Suwa | |
| 5,605,403 | A | * | 2/1997 | Vegeais et al. | 400/207 |
| 5,620,265 | A | * | 4/1997 | Kondo | 400/196 |
| D383,743 | S | | 9/1997 | Suwa et al. | |
| 5,695,292 | A | * | 12/1997 | Coote | 400/250 |
| 5,709,485 | A | * | 1/1998 | Kohno | 400/208 |
| 5,775,821 | A | | 7/1998 | Kato | |
| 5,865,545 | A | * | 2/1999 | Kondo | 400/207 |
| 5,897,256 | A | | 4/1999 | Kameyama | |
| 5,913,621 | A | | 6/1999 | Kameyama et al. | |
| 5,961,229 | A | | 10/1999 | Kameyama | |
| 5,984,546 | A | | 11/1999 | Kameyama | |
| D425,545 | S | | 5/2000 | Ishida | |
| 6,079,886 | A | | 6/2000 | Kameyama | |
| 6,161,972 | A | | 12/2000 | Kameyama et al. | |
| D442,211 | S | | 5/2001 | Hayasi et al. | |
| 6,257,780 | B1 | | 7/2001 | Ito et al. | |

FOREIGN PATENT DOCUMENTS

| | | | |
|---|---|---|---|
| EP | 0 852 182 | A1 | 7/1998 |
| EP | 0 931 672 | A1 | 7/1999 |
| EP | 0 852 182 | B1 | 11/1999 |
| EP | 1 000 765 | A2 | 5/2000 |
| JP | 2001026156 | A | 1/2001 |

OTHER PUBLICATIONS

JP 2001026156 A—Japan (Abstract in English).

* cited by examiner

*Primary Examiner*—Ren Yan
*Assistant Examiner*—Dave A. Ghatt
(74) *Attorney, Agent, or Firm*—Fay, Sharpe, Fagan, Minnich & McKee, LLP

(57) ABSTRACT

An ink cartridge has a pair of sideplates (14, 16) which connect a first portion (10) of the housing to a second portion (12). The sideplates expand to allow spindles (70, 72, 90, 92) and spools (50, 60) to be installed within openings of the housing. The sideplates are spaced apart and are generally parallel to each other. The sideplates are pulled in opposing directions from a first dimension between the sideplates to a second dimension slightly greater than the first dimension.

17 Claims, 4 Drawing Sheets

INK RIBBON CARTRIDGE WITH EXPANDABLE SIDEPLATES

BACKGROUND OF THE INVENTION

This invention relates generally to an ink ribbon cartridge for use with a printer or facsimile machine and, more particularly, to a thermal ink ribbon cartridge having one piece expandable sideplates which eliminate hinged connections and are easier to load with ink ribbon. The invention provides for an ink ribbon cartridge which ensures proper, reliable mounting of an ink ribbon.

Generally an ink ribbon cartridge is used because of the simplicity of handling when a thermal printer is used to print on paper. However, when a thermal printer uses a large ink ribbon cartridge, it is uneconomical for the whole cartridge to be thrown away after use. To obviate this drawback, an ink ribbon alone is replaced. The ink ribbon typically includes a band-like sheath comprising a resin film with a layer of ink formed on one side and is wound around a pair of cardboard spools.

A prior art ink ribbon cartridge using this type of ink ribbon is constructed such that at the time of ink ribbon replacement, a cover is unhinged, the used ink ribbon is taken out, and four spindles are removed from notches in the cartridge housing and from ends of the spools. The housing includes covers over each of the spools which are attached to the frame of the housing by living hinges and are secured into place by snaps which engage the covers and the frames of the housing. The covers are formed of two semi-cylindrical portions. The covers are locked into place by the snaps after the spools have been installed into the housing. Subsequently, the ink ribbon cartridge is mounted into a printer or facsimile system.

It is desired to provide an ink ribbon cartridge which does not have hinge members or snap members and is easy to load and unload with replacement ink ribbon and spools. Accordingly, it is desirable to develop a new and improved ink ribbon cartridge which meets the above-state needs and others and provides better, more advantageous overall results.

SUMMARY OF THE INVENTION

Generally speaking, the present invention relates to an ink ribbon cartridge which has a one-piece sideplate for installing and removing ink ribbon and spools.

More particularly, the invention relates to an ink ribbon cartridge which has a one piece sideplate which is expandable to easily remove and install take-up and supply spools having ink ribbon attached thereto. Thus, there are no hinge members or lock snap features required to retain the spools and ink ribbon within the ink ribbon cartridge.

In particular, an ink cartridge includes an ink ribbon, first and second spools for holding the ribbon, and four spindles. A spindle is received within a respective opening in an end of the spools. The housing has a first portion and a second portion which receive the first and second spools. A pair of sideplates connect the first portion to the second portion. The sideplates expand to allow the spindles to be installed within aligned holes of the sideplates. The sideplates are spaced apart and are generally parallel to each other. The first portion and second portion each have semi-cylindrical members that at least partially cover the spools.

The housing is formed of thermoplastic material and is a one-piece construction. First and second portions of the housing each have wall members at opposite ends which are generally normal to a longitudinal axis of the portions. Each of the wall members has a hole or opening for receiving the spindles. The sideplates are selectively pulled in opposing directions from a first dimension between the sideplates to a second dimension which is slightly greater than the first dimension.

One advantage of the present invention is the provision of an ink ribbon cartridge having a one piece construction to minimize parts that is easy to manufacture.

Another advantage of the present invention is the provision of an ink ribbon cartridge that eliminates any hinge members or snap lock features and is easy to load and unload with ink ribbon and spools.

Yet another advantage of the present invention is the provision of an ink ribbon cartridge which provides better retention of take-up spools and supply spools within the ink cartridge housing.

Still other aspects and advantages of the invention will become apparent to those skilled in the art upon a reading and understanding of the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
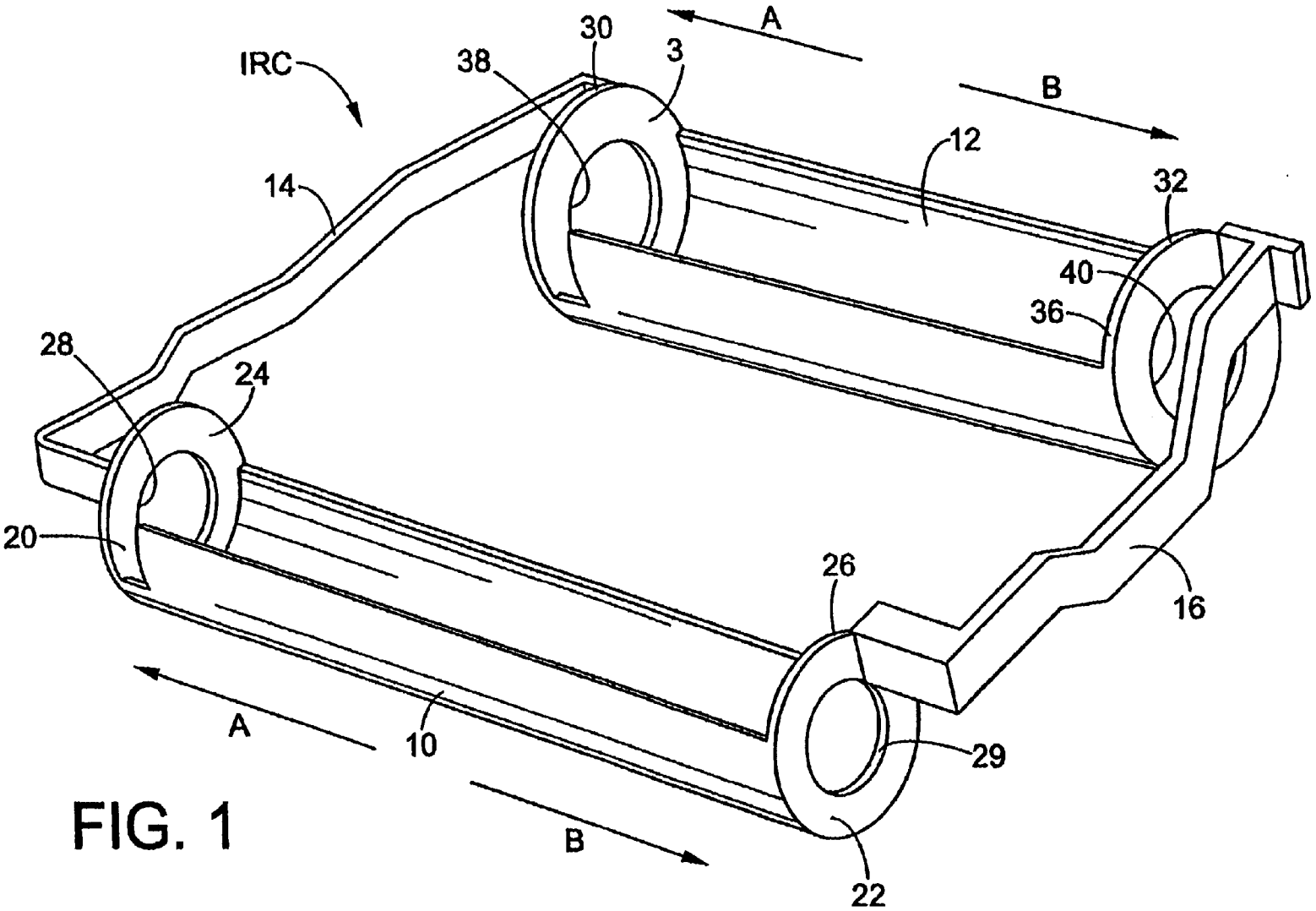
FIG. 1 is a perspective view of a one piece ink ribbon cartridge housing having expandable sideplates in accordance with the preferred embodiment of the present invention.

Referring now to the drawings, wherein the showings are for purposes of illustrating the preferred embodiment of the invention only and not for purposes of limiting same, FIG. 1 shows an ink ribbon cartridge IRC having a one piece construction in accordance with the present invention.

More particularly, the ink ribbon cartridge has a first semi-cylindrical portion or section 10, a second semi-cylindrical portion or section 12, and connecting sections or sideplates 14, 16 extending between and interconnecting the first and second semi-cylindrical sections. The ink ribbon cartridge housing is preferably unitarily molded of a resin or similar material. Each semi-cylindrical section 10, 12 extends along the length of either a supply spool or a take-up spool and partially covers a periphery or circumference of each spool.

Semi-cylindrical section 10 has a first end 20 and a second end 22. Each end 20, 22 has a wall 24, 26, respectively, spaced in generally parallel relation with each other and normal to an elongated axis separating them. Each wall 24, 26 is preferably circular or round in shape and has an opening or a round hole 28, 29, respectively through a center of the wall. Similarly, semi-cylindrical section 12 has a first end 30 and a second end 32 with axially spaced walls 34 and 36. Walls 34, 36 are likewise preferably circular or round in shape and have openings or round holes 38, 40, respectively, formed in the center of the walls. Similarly, walls 34, 36 are generally parallel to each other and are approximately normal to a longitudinal axis of the semi-cylindrical section 12.

Sideplate 14 connects walls 24, 34 together and sideplate 16 connects walls 26, 36 together. Sideplate 14, 16 are spaced apart and generally parallel to each other. The sideplates have a configuration that conforms to the printer or facsimile machine, and maintain the connecting sections in generally fixed, spaced relation.

Openings 28, 29 preferably are equal in diameter; similarly, openings 38, 40 are equal in diameter. In FIG. 1, all of the opening formed in the walls are shown to have approximately the same diameter; however, the openings may be of varying diameters without departing from the scope of the invention.

The ink ribbon cartridge is formed of a resilient material such that the sideplates 14, 16 may be grasped by the user and pulled outwardly in opposing directions A, B thus expanding the length of semi-cylindrical sections 10, 12 and slightly pulling apart walls 34, 36 and walls 24, 26 from a first dimension between the walls to a second dimension slightly greater than the first dimension for receiving spools between the walls. The pulling force imposed on the sideplates remains in the elastic level so that the sideplates return to their original spacing upon release of the pulling force.

Figure 2:
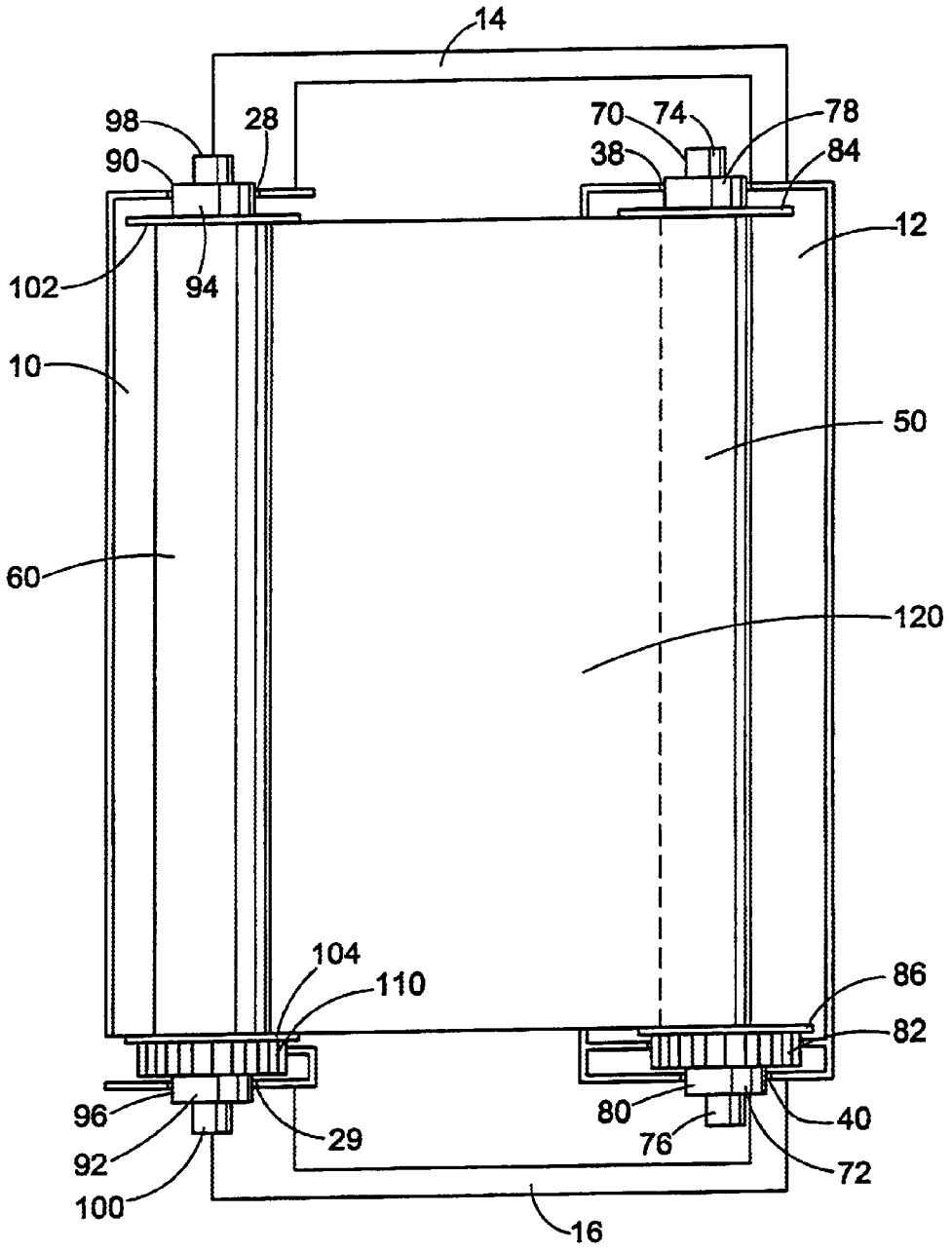
FIG. 2 is a top plan view of the ink ribbon cartridge of FIG. 1 with supply and take-up spools mounted therein.

Referring now to FIG. 2, a take-up spool 50 is received within semi-cylindrical section 12 and a supply spool 60 is received within semi-cylindrical section 10. Preferably, spools 50, 60 are made of cardboard, however, other materials may be used without departing from the scope of the present invention. Take-up spool 50 receives a spindle 70 at one end and a spindle 72 at an opposite end. The spindles are preferably made of a resin or thermoplastic material. As seen in FIG. 2, each spindle has a cylindrical section 74, 76, respectively and a disk-shaped portion 78, 80, respectively, adjacent thereto. Spindle 72 further comprises a gear portion 82 that cooperates with a drive gear (not shown) provided on the printer or facsimile machine in a manner well known in the art. Each spindle further comprises an enlarged diameter flat disk portion 84, 86, respectively, that is dimensioned to prevent passage through the wall openings 28, 29 or 38, 40.

Spindle 70 is received by opening 38 in wall 34 and spindle 72 is received in opening 40 of wall 36. Particularly, disk-shaped portions 78, 80 are dimensioned to extend through the openings 38, 40, respectively, and can be freely rotated relative to the housing.

Spool 60 has spindles 90, 92 at opposite ends thereof. As with the other spindles, spindles 90, 92 have disk-shaped portions 94, 96, and cylindrical portions 98, 100, respectively. Each spindle also has a flat disk portion 102, 104, respectively, disposed adjacent the cylindrical portions. Spindle 92 further has a gear-portion 110 that matingly engages a gear (not shown) operatively associated with the printer or facsimile machine. Disk-shaped portions 94, 96 are received in openings 28, 29 of walls 24, 26, respectively. An ink ribbon 120 is wound around the supply spool and take-up spool. In FIG. 2, the ink ribbon is wound around the spools so that the spools rotate in opposite directions as the ink ribbon is advanced from the supply spool to the take-up spool. It will be appreciated, however, that the ink ribbon can be wound so that the spools rotate in the same direction without departing from the scope and intent of the present invention.

Figure 3:
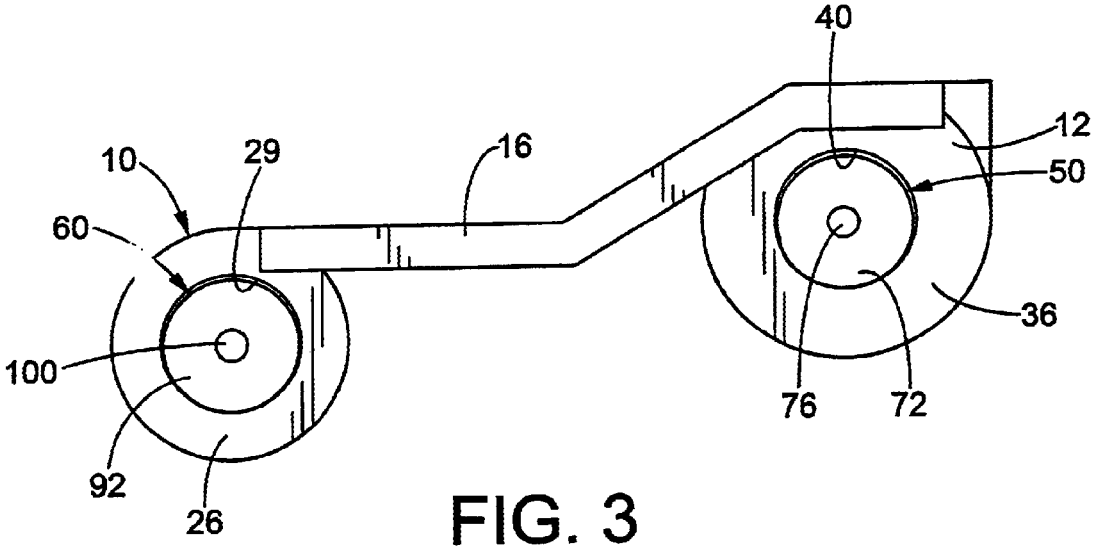
FIG. 3 is a side elevational view of the ink ribbon cartridge of FIG. 1 with supply and take-up spools installed therein; and, FIG. 4 is a bottom plan view of an ink ribbon cartridge of FIG. 1 having supply and take-up spools and an ink ribbon mounted therein.
Figure 4:
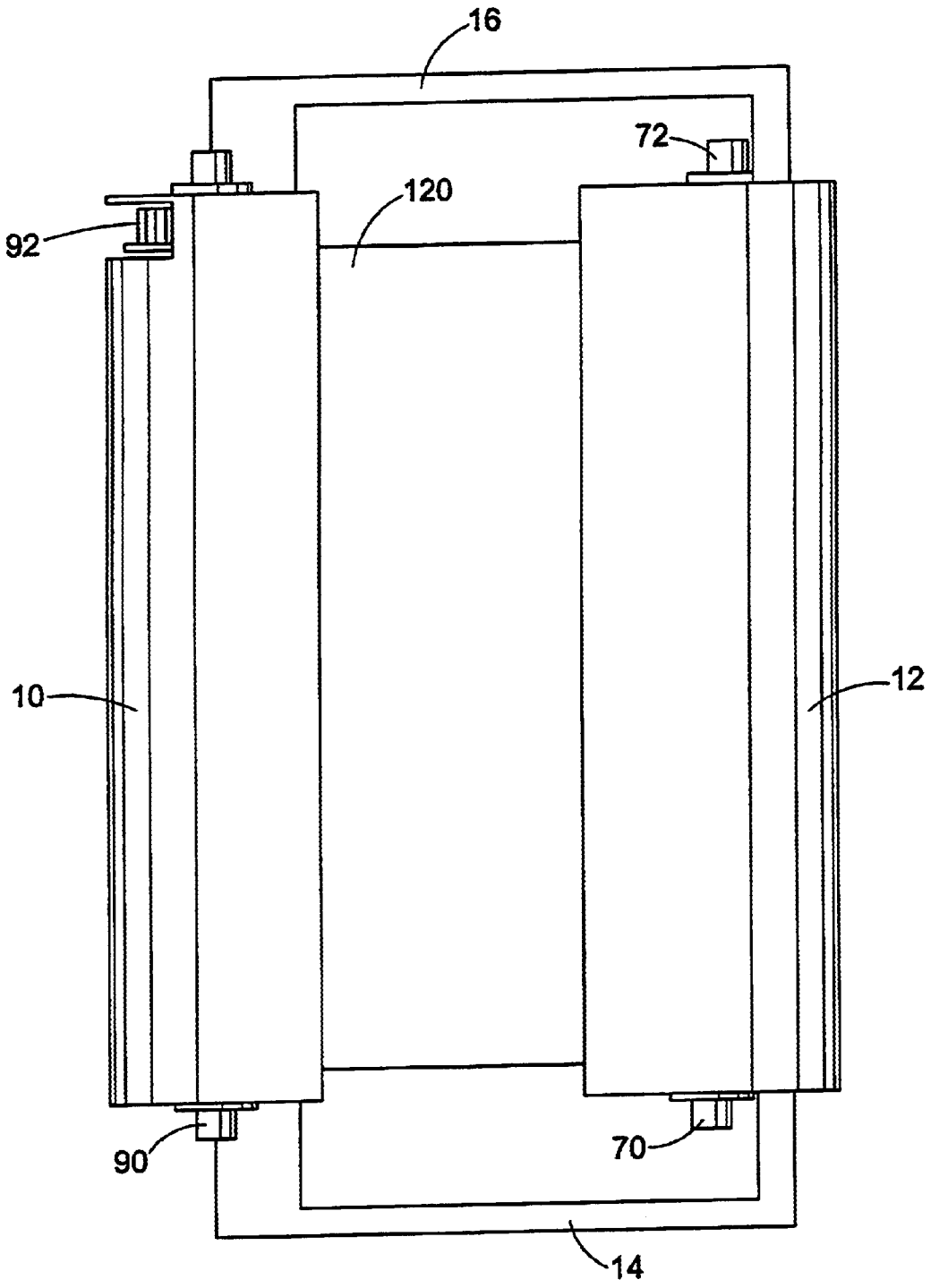

FIG. 3 illustrates the spindles 92, 72 installed in openings 29, 40 of semi-cylindrical sections 10, 12. FIG. 4, on the other hand, illustrates a bottom view of the ink ribbon cartridge showing the semi-cylindrical members 10, 12 covering at least a portion of the circumference of the spools 50, 60, here extending over approximately 180° and along the entire axial length. As seen in FIG. 2, the gear spindles 92, 72 are preferably identical. However, different gear spindles of varying diameter or shape may be used without departing from the scope of the present invention. Similarly, spindles 70, 90 are shown to have the same diameter disk portions. These spindles, though, may have varying diameters and shapes to meet the particular needs or requirements of the printer or facsimile machine.

To install spools 50, 60 along with the ink ribbon into the ink ribbon housing according to a preferred method of the present invention, the sideplates 14, 16 are pulled apart in opposing directions A and B as illustrated in FIG. 1. Thus, walls 24, 26 are slightly pulled apart from each other and walls 34, 36 are slightly pulled apart from each other to provide for a slightly greater dimension between the walls for receiving the spindles 50, 60. The spindles are then snap fit into the openings within the walls 24, 26, 34, 36. Once the spindle disk portions are received within the openings, the pull-apart force is released from the sideplates 14, 16 and the housing is allowed to return to its original configuration. The spindles are then retained and locked into place within the openings of the walls of the semi-cylindrical sections. To remove the spools from the semi-cylindrical sections, again, the sideplates 14, 16 are pulled apart until the spools are able to be released from the openings retaining the spindles. The spindles and spools are then pulled away from the openings and are removed from the ink ribbon housing. Then the force applied to the sideplates 14, 16 is released, thus allowing the ink ribbon housing to again return to its original configuration.

The ink ribbon housing of the present invention thus eliminates the need for living hinges or hinge member or snap arrangements which have heretofore been used to retain the spindles and spools onto the ink ribbon housing. The ink ribbon housing may be compatible with a variety of dimensions of spindles and spools. The housing allows for easy removal and installation of spools and spindles and eliminates extra components allowing for easier manufacture at a reduced cost.

The ink ribbon housing also prevents improper mounting of spindles and spools on the housing. Alternately, the ink ribbon housing may be configured to have identical openings in each location to allow for spindles to be interchanged at different locations on either semi-cylindrical section 10 or 12.

The invention has been described with reference to a preferred embodiment. Obviously, alterations and modifications will occur to others upon a reading and understanding of this specification. It should be noted that variations on the configuration of the ink ribbon housing would fall within the scope and intent of the present invention. The specification is intended to include all such modifications and alterations insofar as they come within the scope of the appended claims or the equivalents thereof.

Having thus described the preferred embodiment, the invention is now claimed to be:

1. An ink ribbon cartridge, comprising:

an ink ribbon;

first and second spools holding said ribbon;

four spindles received within respective openings in the ends of said spools;

a housing having a first portion and a second portion that receive the first and second spools respectively, each said first and second portion having an end wall at the opposite ends thereof, said end walls having four openings of equal diameter which receive said spindles, each said end wall having an upper portion flexible axially of the corresponding opening; and, a pair of sideplates each of which connects the upper portions of the end walls at a different one of the opposite ends of said first portion and said second portion, wherein said sideplates and upper ends expand from a first position to allow said spindles to be installed within said openings of said end walls and then said sideplates and upper ends return to said first position.

2. The ink ribbon cartridge of claim 1, wherein said sideplates are spaced apart and are generally parallel to each other.

3. The ink ribbon cartridge of claim 1, wherein said first portion and said second portion each at least partially cover one of said spools.

4. Ink ribbon cartridge of claim 1, wherein said first portion and said second portion are spaced apart and are generally parallel to each other.

5. Ink ribbon cartridge of claim 4, wherein said first portion and said second portion each comprise semi-cylindrical sections.

6. The ink ribbon cartridge of claim 1, wherein said sideplates are pulled in opposing directions from a first dimension between said sideplates to a second dimension slightly greater than said first dimension.

7. Ink ribbon cartridge of claim 1, wherein said housing comprises thermoplastic material.

8. The ink ribbon cartridge of claim 7, wherein said first and second portions comprise a resilient material.

9. The ink ribbon of claim 1, wherein each of said end walls has a round hole receiving one of said spindles.

10. The ink ribbon cartridge of claim 9, wherein said end wall are circular in shape.

11. The ink ribbon cartridge of claim 1, wherein said first portion and walls are generally parallel to each other, and said second portion end walls are generally parallel to each other.

12. The ink ribbon cartridge of claim 1, wherein said housing is formed of a one-piece construction.

13. A method of inserting a take-up spool and a supply spool into an ink ribbon cartridge housing, comprising the steps of:

slightly pulling apart the upper portions of apertured end walls at opposite ends of said housing by pulling two sideplates of said housing each attached to the upper portion of a pair of the end walls at a different end of said housing in opposite directions along their lengths from a first dimension between the end walls to a second dimension which is slightly larger than said first dimension;

inserting a first end of a take-up spool into an opening in an end wall attached to one of said sideplates;

inserting a take-up spool second end opposite said first end in an opening in the end wall attached to the other of said sideplates;

inserting a first end of a supply spool in an opening in an end wall attached to the one of said sideplates;

inserting a supply spool second end opposite said first end into an opening in the end wall attached to the other of said sideplates; and, releasing said sideplates to return to said first dimension.

14. The method of claim 13, further comprising the steps of inserting a spindle into each of said take-up spool and said supply spool.

15. The method of claim 14, further comprising the step of inserting said spindles in said openings of said sideplates.

16. The method of claim 14, wherein the spindle inserting steps occur before the spool inserting steps.

17. The method of claim 13, wherein the first and second ends of the take-up spool inserting steps are performed one after the other.

* * * * *